United States Patent [19]

Cash

[11] 4,449,272

[45] May 22, 1984

[54] CHUTE FEED ADJUSTMENT FOR CARD EVENNESS

[75] Inventor: Leonard D. Cash, Gastonia, N.C.

[73] Assignee: Fiber Controls Corporaton, Gastonia, N.C.

[21] Appl. No.: 370,843

[22] Filed: Apr. 22, 1982

[51] Int. Cl.[3] ..... D01G 15/42

[52] U.S. Cl. ..... 19/105; 19/106 R; 19/159 R

[58] Field of Search ..... 19/105, 106, 150, 159 R

[56] References Cited

U.S. PATENT DOCUMENTS

| | | | |
|---|---|---|---|
| 3,728,759 | 4/1973 | Hergeth | 19/105 |
| 3,750,235 | 8/1973 | Wise | 19/105 |
| 4,001,916 | 1/1977 | Grimshaw et al. | 19/105 X |
| 4,008,511 | 2/1977 | Oda | 19/105 |
| 4,009,803 | 3/1977 | Lytton et al. | 19/105 |
| 4,051,575 | 10/1977 | Hutcheson | 19/159 R |
| 4,100,650 | 7/1978 | Wirth et al. | 19/105 |
| 4,154,485 | 5/1979 | Lytton et al. | 19/105 X |

FOREIGN PATENT DOCUMENTS

| | | | |
|---|---|---|---|
| 545004 | 6/1956 | Italy | 19/150 |

*Primary Examiner*—Louis Rimrodt

*Attorney, Agent, or Firm*—Cushman, Darby & Cushman

[57] ABSTRACT

A textile processing system is disclosed in which a chute feeder is juxtaposed with a card as a web supply device for the card, and the card, in turn, is juxtaposed with a coiler device, typically a dual coiler, for coiling sliver into cans, from the output of the card. In order to reduce variation in weight of fiber per unit width across the width of the output of the card, the horizontal angle of the chute feed output relative to the horizontal angle of the card input is made adjustable. In the preferred embodiment this is accomplished by mounting the chute feed for controlled, limited pivotal movement about a vertical axis generally coinciding with one lateral margin of the chute feed, the adjustment members being provided at the opposite lateral margin of the chute feed.

9 Claims, 3 Drawing Figures

CHUTE FEED ADJUSTMENT FOR CARD EVENNESS

BACKGROUND OF THE INVENTION

For many years it has been customary to feed cards (carding machines) from laps of fibers, which have been formed, for example, by a picker machine or the like. To accomplish this, manpower and diverse machinery have been employed to transfer the laps from the pickers to the cards. Generally, a lap of fibers unrolls with a web of fairly uniform density and thickness, and consequently is quite suitable for feeding into a card. More recently, however, efforts have been made to obviate the necessity of forming a lap and transporting it from a picker to the card which is to use it. With the advent of efficient pneumatic conveying systems, especially condensers for removing fibers from the air stream and supplying them to equipment, it has become easier to supply fibers directly to cards. A web of fibers has been fed directly to a card, other than by a lap, in the required density and thickness uniformity with various types of regulating devices which have been generally known by various terms such as chute feeds, feeding regulators, web formers and the like. These web formers have been used in various manners, such as receiving the previously opened fibers directly from a condenser in a pneumatic conveyor system. In addition, web formers have been employed as the output equipment of opening and feeding hoppers.

When a chute feeder is juxtaposed upstream of a card as a web supply means therefor, often a single motor means is used to drive both devices, with suitable drive belt and sprocket means operatively interconnecting the two devices. Such a combination of equipment is illustrated in FIG. 2 of the U.S. Pat. No. 3,750,235, of Wise, issued Aug. 7, 1973. In the instance depicted, in this Wise patent, the chute feeder is shown resting on the floor in simple juxtaposition with the card. In other instances, the chute feeder may be physically supported upon an upstream end portion of the frame of the card. Such an arrangement is depicted in FIG. 1 of the U.S. Pat. No. 4,009,803, of K. G. Lytton et al, issued Mar. 1, 1977. In other instances, the chute feeder may be supported upon some other item of equipment or on a pedestal, stand or the like.

Quite usually a third item of textile processing equipment, a coiler, is juxtaposed downstream of a card, so that the output web of the card is coiled into a can. In the U.S. Pat. No. 4,154,485, of K. G. Lytton et al, issued May 15, 1979 a plurality of such three-part units are shown connected in a system to be operated in parallel, with a manifold supplying fibers to the chute feeders of all the units. In a modern "dual coiler" variation, two coilers are positioned side-by-side at the front of the card. In using such an arrangement, the output web of the card is split longitudinally into a left portion which is developed by the left coiler as a sliver coilingly fed into the left can, and into a right portion which is developed by the right coiler as a sliver coilingly fed into the right can.

Typically, when a chute feeder is mated with a card, the chute feeder is selected so as to provide as output a batt that is somewhat narrower than the maximum width which could be accepted by the card, e.g. a thirty-six inch wide feed for a forty inch card, this to accommodate some migration without causing migration onto the sides of the card.

Particularly as cards are run at faster speeds to process more weight of fiber per unit time, uniformity of the output, especially for a dual coiler, has become a problem, both due to variations within the feed to each coiler and variations between the feeds to the coilers.

The present invention has determined that a substantial proportion of the variability results from improper juxtaposition of the chute feeder with the card, particularly as to relative lateral positioning. Although it might be possible to reduce the variability by shifting the entire card slightly to the left or to the right relative to the chute feeder, or vice versa, such an adjustment is considered impractical due to consequential disruption of piping connections and the like.

SUMMARY OF THE INVENTION

A textile processing system is disclosed in which a chute feeder is juxtaposed with a card as a web supply device for the card, and the card, in turn, is juxtaposed with a coiler device, typically a dual coiler, for coiling sliver into cans, from the output of the card. In order to reduce variation in weight of fiber per unit width across the width of the output of the card, the horizontal angle of the chute feed output relative to the horizontal angle of the card input is made adjustable. In the preferred embodiment this is accomplished by mounting the chute feed for controlled, limited pivotal movement about a vertical axis generally coinciding with one lateral margin of the chute feed, the adjustment members being provided at the opposite lateral margin of the chute feed.

The principles of the invention will be further discussed with reference to the drawing wherein a preferred embodiment is shown. The specifics illustrated in the drawing are intended to exemplify, rather than limit, aspects of the invention as defined in the claims.

DETAILED DESCRIPTION

Figure 1:
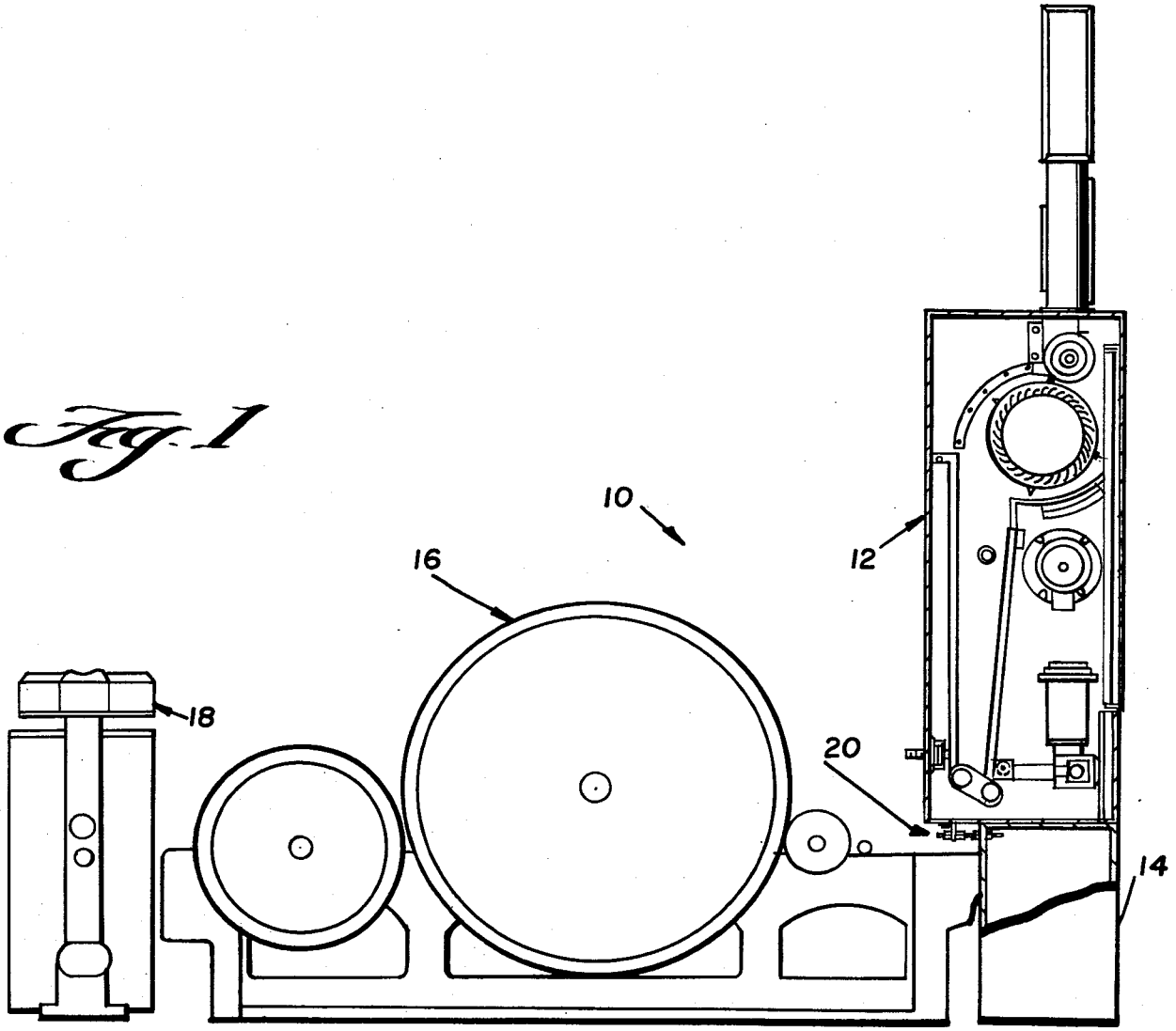
FIG. 1 is a somewhat schematic side elevational view, with portions omitted for clarity, of a textile processing system in which a chute feeder serves a card which serves a sliver coiling device, wherein the chute feeder is mounted for adjustment to compensate for side-to-side weight difference of the card output to the coiler device.

In FIG. 1, a textile processing system is illustrated at 10 as including, proceeding right to left, a chute feed 12, supported upon a pedestal or base 14, a card 16 and a coiler 18 (for instance a dual coiler, of which only the near-side coiler unit is visible in this view, the far-side coiler being identical to it and obscured by it in this view). All of these may be generally conventional or well-known, commercially available items of equipment. For example, the chute feed may be a model ML-5 chute feed manufactured by Fiber Controls Corporation, of Gastonia, N.C. 28052, and the card/coiler arrangement may be a Hollingsworth Americard Dual Coiler.

Figure 2:
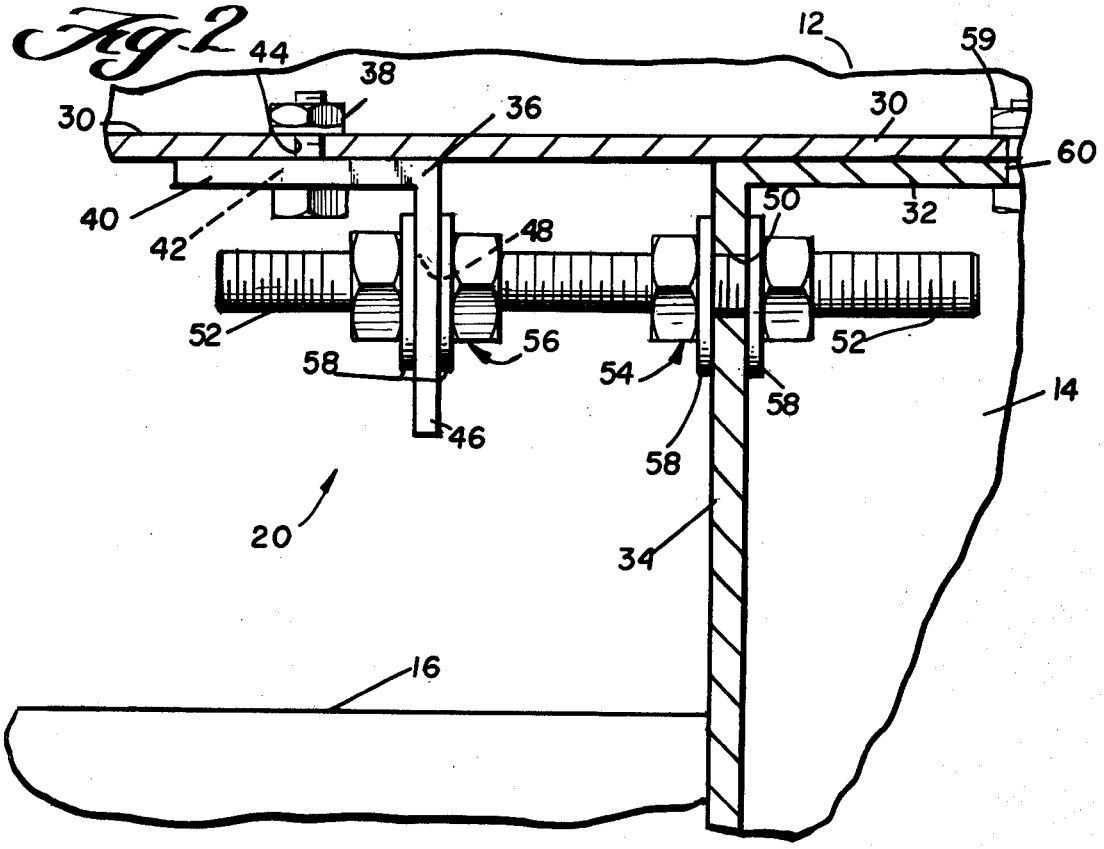
FIG. 2 is an enlarged side elevational view of the preferred adjustment means.

An exempliary adjustment feature provided in accordance with the principles of the present invention is shown illustrated generally at 20 in FIG. 1, and on a larger scale in FIG. 2.

Figure 3:
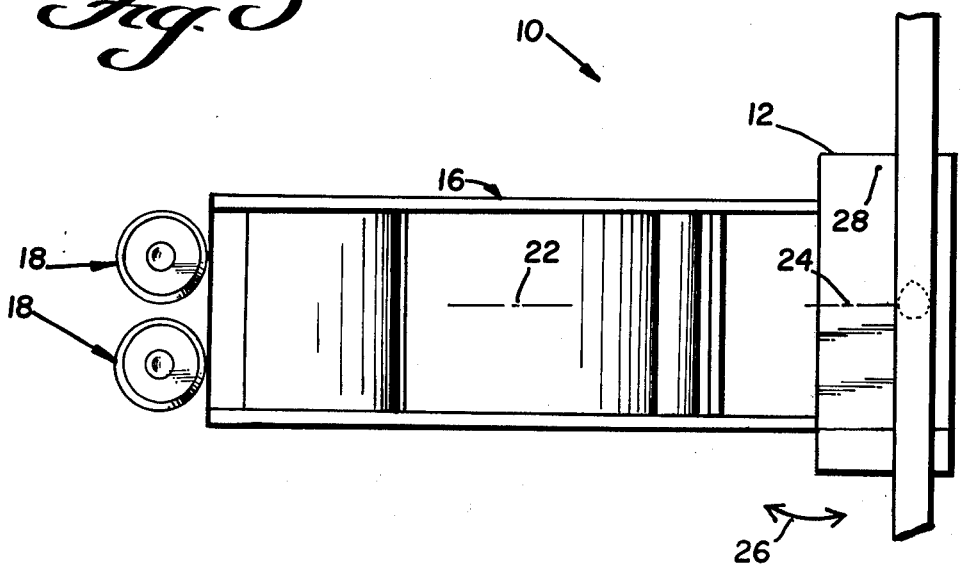
FIG. 3 is a schematic top plan view of the apparatus of FIG. 1 on a smaller scale, illustrating, with some exaggeration for emphasis, the nature of the adjustment provided in accordance with the principles of the present invention.

The system 10 is shown schematically in FIG. 3. The ideal spatial relationship of the card 16 to the chute feed 12 is the one which causes the output of the card to have minimized side-to-side variation, so that as divided and furnished to the coilers, should there be two as shown, the left side and right side products as are indistinguishable from one another as possible, and each is a consistent product. Nominally, the ideal spatial relationship is the one wherein the longitudinal center line 22 of the card 16 is co-planar with the longitudinal center line 24 of the chute feed 12. However, the present inventor has found that an adjustment feature is needed in order to achieve the actual ideal spatial relationship, whether the effect of adjustment is to produce or to cause more or less variation from the co-planarity just referred to.

In a preferred embodiment, the adjustment feature 20 is physically located so as to act between the chute feed 12 and whatever it is that the chute feed is supported upon in order to pivot, swivel, skew, turn or similarly to move the chute feed slightly in a generally angular sense about a generally vertical axis without causing any significant lateral translation of the chute feed, i.e. such as would disturb connections of fiber feed ducting to the chute feed, or of drive connections extending between the chute feed and the card.

As illustrated in FIG. 3, an exemplary way that this can be accomplished is to provide the adjustment feature 20 at one lateral end of the chute feed, which, upon adjustment moves that end of the chute feed towards and away from the card along an arc generally indicated by the double-headed arrow 26. The axis of this arcuate movement in this instance may be located in the vicinity of the opposite lateral end of the chute feed, e.g. at 28. However, if considered necessary or desirable a similar adjustment feature may be provided at 28, so that when only the adjustment feature at 20 is adjusted, pivotal movement is about an axis at 28, and when only the adjustment feature at 28 is adjusted, pivotal movement is about an axis at 20, whereas if both are adjusted, e.g. to lengthen one and shorten the other, the effective axis of the pivotal movement lies somewhere between the two lateral ends of the chute feed.

As indicated, each adjustment feature, e.g. the adjustment feature 20 is mounted to act between the chute feed and whatever it is that the chute feed is supported-upon. In the embodiment shown in FIGS. 1 and 2, the chute feed 12 is supported upon a stationary pedestal, stand or base 14 and it is between these two members that the adjustment feature 20 is mounted to act in the illustrated embodiment. However, because as hereinbefore stated the chute feed in utterly equivalent instances may rest directly on the floor, or upon the card, the adjustment feature in those instances would be mounted to act between the chute feed and the floor, and between the chute feed and the card, respectively.

Now, to describe the illustrated preferred embodiment of the adjustment feature 20 in more detail, reference will be made to FIG. 2. In FIG. 2 one is looking at structure located adjacent the near side of the system 10. The horizontal bottom wall of the chute feed 12 is illustrated at 30 and the horizontal top wall of the chute feed support stand 14 is illustrated at 32. The chute feed 12 is seen to forwardly overhang the stand 14 so as to be desirably adjacent the card 16. The vertical front wall of the stand 14 is indicated at 34.

An L-shaped angle bracket 36 is shown secured by a nut and bolt assembly 38 to the underside of the bottom wall 30 of the chute feed, forwardly of the stand 14. The bracket 36 is disposed in an inverted condition, so that its horizontal flange 40 is uppermost. This flange is provided with a slot 42 vertically therethrough, which slot is elongated transversally of the system 10. The nut and bolt assembly 38 is fastened through this slot 42 and through a hole 44 provided in the bottom wall 30 of the chute feed.

The vertical flange 46 of the angle bracket 36, which is shown extending transversally at the rear is provided with a horizontal opening 48 through the thickness of the flange.

On line with the opening 48, a horizontal opening 50 is formed through the front wall 34 of the stand 14.

A threaded rod 52, e.g. five inches long is shown received through the aligned openings 48 and 50, its disposition being adjustably fixed by respective nut/-lock nut pairs 54 and 56. In each instance a washer 58 is shown intervened between the respective nut or lock nut and what it bears against.

In order to move the near end of the feed chute rearwardly away from the card (i.e. relatively to the right in FIG. 2), the lock nut of the pair 54 may be loosened a few turns and the nut of that pair tightened a few turns until the connection is tight again. This pulls the flange 46 towards the wall 34, just jacking the near end of the feed chute 12 backwards (i.e. to the right) on the stand 14, with the far end of the feed chute 12 (not shown in this view), remaining where it was. The slot 42 accommodates the slight arc to this movement. Similarly, if nut and bolt assemblies or the like are provided vertically between the top of the stand and the bottom of the feed chute, e.g. as illustrated at 59, one or the other or both of the respective openings may be slotted, e.g. as illustrated at 60 to accommodate the necessary movement. Like the nut and bolt assembly 38, the nut and bolt assembly or assemblies 58 are normally kept tight but are slightly loosened when an adjustment is to be made of the chute feed, and after the adjustment is made, these nut and bolt assemblies may be retightened to the extent considered necessary.

The near end of the chute feed is moved towards the card, i.e. towards the left in FIG. 2 by a comparable manipulation of the elements just described.

In order to permit the principles and operation of the preferred embodiment and the invention to be even better understood, a practical example is now given.

EXAMPLE

Using the system of FIGS. 1–3, in which the chute feed 12 was a Fiber Controls ML-5 chute feed (thirty-six inch wide output) and the card/coiler was a Hollingsworth Americard II Dual Coiler (forty inch wide card capacity) having a right side coiler and a left side coiler, a series of tests were run using as a test fiber 431 Fortrel polyester 1.5×1.5 at a card production rate of 120 pounds per hour.

For the first test run, the chute feed was nominally aligned with the card. The sliver obtained by the right side collar was compared with that obtained by the left side coiler for uniformity of weight per standard unit length (grains per ten yards) to obain the highest and lowest values, and, for each side, the coefficient of variation (CV), using the industry-standard Uster method. From the first test run, the following results were obtained:

TEST RUN NO. 1

| | Right Side Coiler | Left Side Coiler |
|---|---|---|
| Highest | 55.8 | 59.8 |
| Lowest | 55.0 | 59.4 |
| Uster CV | 4.3% | 5.4% |

The results of the first test run are interpreted as indicating that too much fiber is being fed to the left. Accordingly, for the second test run, the left side of the chute feed was moved about one-sixteenth inch closer to the card by respective manipulation of the adjustment feature 20, and the following results were obtained:

TEST RUN NO. 2

| | Right Side Coiler | Left Side Coiler |
|---|---|---|
| Highest | 56.6 | 57.1 |
| Lowest | 55.4 | 58.6 |
| Uster CV | 4.4% | 5.4% |

The results of the second test run indicate that some improvement in side-to-side card output uniformity has been achieved by the adjustment although the coefficient of variability on each side desirably would be lower. For the third test run, two changes were made. First, the left side of the chute feed was brought another sixteenth of an inch closer to the card by corresponding manipulation of the adjustment feature 20, seeking to further even out the weight difference between coilers and to lower the coefficients of variability. Second, in order to eliminate batt fast drafting due to cock, the sprocket on the card feed roll conventionally used with an endless chain for driving the card feed roll from the feed roll of the feed chute was changed from a fourteen tooth sprocket to a fifteen tooth sprocket, thus reducing draft by slightly reducing the rate at which the card feed roll was driven. Then, from the third test run, the following results were obtained:

TEST RUN NO. 3

| | Right Side Coiler | Left Side Coiler |
|---|---|---|
| Highest | 56.8 | 57.9 |
| Lowest | 56.7 | 57.2 |
| Uster CV | 3.4% | 3.6% |

The target weight being 57 grains, and these coefficients of variability being acceptably low, the system 10 is considered from the results of the third test run to be properly adjusted for continued use.

It should now be apparent that the chute feed adjustment for card evenness as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For a card inlet web supply means that is adapted to be juxtaposed behind a card, upon a card inlet web supply means support, apparatus for adjusting side-to-side uniformity in density of the card outlet web, comprising:

means for adjustably pivoting the card inlet web supply means about a generally vertical axis in such a sense as to bring one lateral end of the card inlet web supply means relatively closer to and further from the card without consequently correspondingly bringing the opposite lateral end of the card inlet web supply means closer to and further from the card, thereby regulating the horizontal angle of web feed to the card in order to regulate side-to-side uniformity in card outlet web density.

2. The apparatus of claim 1, wherein:

the card inlet web supply means is constituted by a feed chute.

3. The apparatus of claim 2, further including:

a feed chute stand constituting said card outlet web supply means support, said feed chute being supported upon said feed chute stand;

said means for adjustably pivoting, being connected between said feed chute and said feed chute stand.

4. The apparatus of claim 3, wherein:

the feed chute stand is a base that is separately provided relative to the card.

5. The apparatus of claim 3, wherein:

the feed chute stand is constituted by a respective portion of the card.

6. The apparatus of claim 3, wherein:

the feed chute stand is constituted by a floor on which said feed chute is supported.

7. The apparatus of claim 3, wherein:

said means for adjustably pivoting comprises a generally horizontal, generally longitudinally extending elongated element and means for effectively lengthening and shortening said element to effectively pull and push the corresponding lateral end of the feed chute towards and away from the card.

8. The apparatus of claim 7, further including:

a dual coiler card juxtaposed with said feed chute to be fed thereby, said dual coiler card having a left side coiler and a right side coiler and means for splitting the card outlet web into a feed for the left side coiler and a feed for the right side coiler, the means for adjustably pivoting being adjustable to cause substantial side-to-side uniformity in density of said feeds to said coilers.

9. The apparatus of claim 1, further comprising:

a dual coiler card juxtaposed with said feed chute to be fed thereby, said dual coiler card having a left side coiler and a right side coiler and means for splitting the card outlet web into a feed for the left side coiler and a feed for the right side coiler, the means for adjustably pivoting being adjustable to cause substantial side-to-side uniformity in density of said feeds to said coilers.

* * * * *